United States Patent [19]

Tsutsumi

[11] 4,028,887

[45] June 14, 1977

[54] INTERNAL COMBUSTION ENGINE WITH IMPROVED EXHAUST PORT

[75] Inventor: Saburo Tsutsumi, Yokohama, Japan

[73] Assignee: Nissan Motor Co., Ltd., Yokohama, Japan

[22] Filed: Mar. 12, 1976

[21] Appl. No.: 666,317

[30] Foreign Application Priority Data

Mar. 15, 1975 Japan ..... 50-31571

[52] U.S. Cl. ..... 60/282; 60/323; 123/193 H

[51] Int. Cl.[2] ..... F01N 3/00

[58] Field of Search ..... 60/282, 323; 123/193 H

[56] References Cited

UNITED STATES PATENTS

| | | | |
|---|---|---|---|
| 2,257,631 | 9/1941 | Wahlberg | 60/323 |
| 3,824,971 | 7/1974 | Skatsche | 123/193 H |
| 3,934,411 | 1/1976 | Masaki | 60/282 |
| 3,965,881 | 6/1976 | Sakurai | 60/282 |

FOREIGN PATENTS OR APPLICATIONS

| | | | |
|---|---|---|---|
| 2,323,793 | 11/1974 | Germany | 60/282 |

*Primary Examiner*—Douglas Hart

[57] ABSTRACT

Adjacent cylinders have respective exhaust ports integrated within the cylinder head to reduce the heat absorbing surface area. The common outlets are disposed as far as is practical from the neighboring head bolts.

14 Claims, 21 Drawing Figures

INTERNAL COMBUSTION ENGINE WITH IMPROVED EXHAUST PORT

This invention relates to internal combustion engines and more particularly to exhaust port arrangement formed in the cylinder heads of the internal combustion engines.

It is a principal object of the present invention to provide an improved internal combustion engine capable of effectively preventing emission of the harmful gases through the exhaust system thereof.

Another object of the present invention is to provide an internal combustion engine having an improved exhaust port arrangement which can promote the oxidation reaction of unburned constituents in the exhaust gases in a reactor connected downstream of the exhaust port.

Further object of the present invention is to provide an improved exhaust port arrangement of an internal combustion engine, capable of maintaining temperature of the exhaust gases at a high level to allow effective thermal reaction of the exhaust gases within a reactor connected downstream of the exhaust port.

Further object of the present invention is to provide an improved cylinder head of an internal combustion engine which cylinder head can prevent leakage of the high pressure combusted gases within the combustion chambers of the engine by preventing excessive thermal expansion of the head bolts securing the cylinder head on the cylinder block.

Other objects and features of the improved internal combustion engine in accordance with the present invention will be more apparent from the following description taken in conjunction with the accompanying drawings in which like reference numerals and characters designate corresponding parts and elements and in which.

It is well known in the art that there are multicylinder internal combustion engines which are equipped with reactors for treating the exhaust gases from the engine by promoting further oxidation reaction of the same therein. Such a type of engines are usually arranged as shown in FIGS. 1 and 2.

Figure 1:
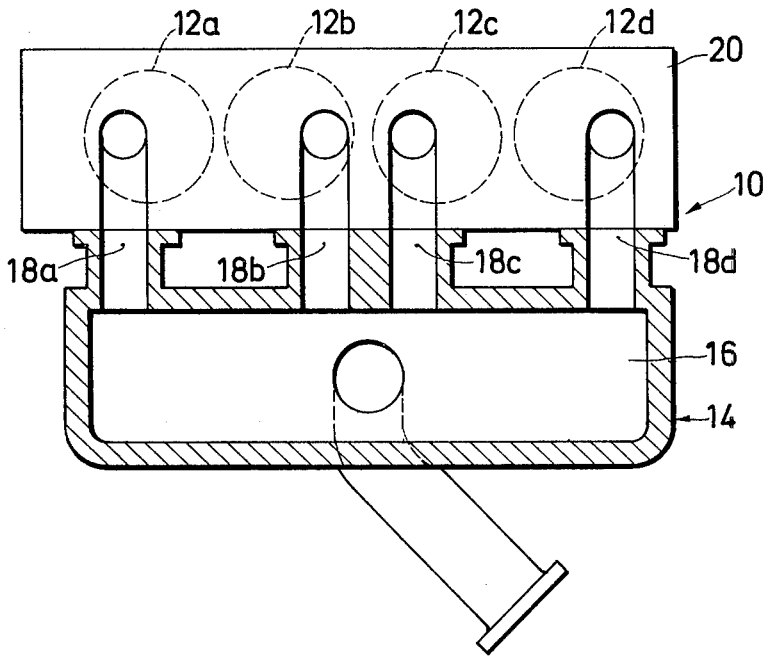
FIG. 1 PRIOR ART
FIGS. 1 and 2 are horizontal section views of prior art internal combustion engines which are respectively equipped with reactors.

In FIG. 1, exhaust gases from the combustion chambers 12*a* to 12*d* of the engine 10 are introduced into the reaction chamber 16 of an exhaust manifold 14 which functions as a reactor through exhaust passages 18*a* to 18*d* including exhaust ports cast in a cylinder head 20 and inlet pipes of the manifold 14. This type of engine has encountered a difficulty in which lowering of the temperature of the exhaust gases from the combustion chambers 12*a* to 12*d* occurs when the exhaust gases are passed through the exhaust passages 18*a* to 18*d* and therefore the oxidation of the exhaust gases within the exhaust manifold 14 is not effectively carried out. This lowering of the exhaust gas temperature results from a relatively large amount of heat in the exhaust gases being absorbed by the relatively high surface area of the inner walls of the exhaust passages 18*a* to 18*d* as the exhaust gases from the combustion chambers 12*a* to 12*d* are introduced into the manifold 14 through exhaust passages 18*a* to 18*d*.

Figure 2:
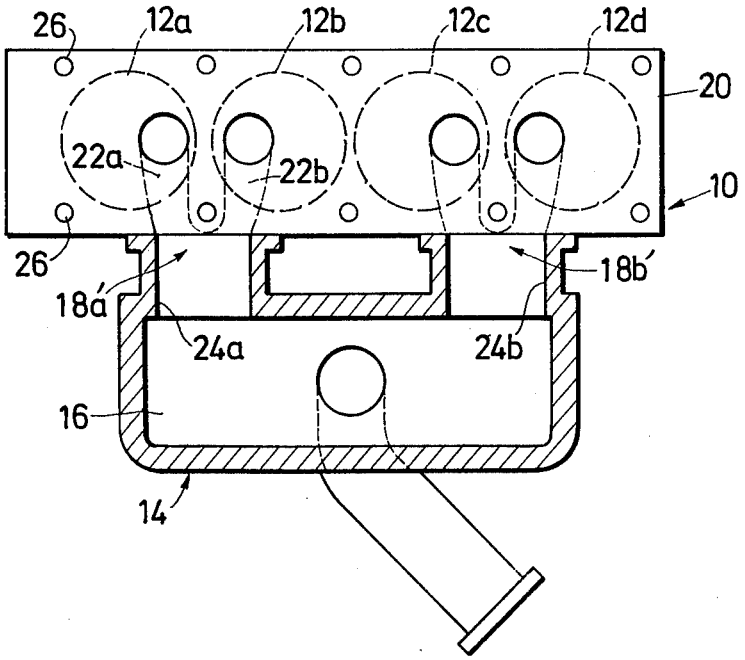
FIG. 2 PRIOR ART

In order to overcome the aforementioned difficulty, the exhaust passages are improved and configurated as shown in FIG. 2, in which the adjacent two exhaust ports, for example, 22*a* and 22*b* of two combustion chambers 12*a* and 12*b* are joined to form so-called siamesed ports, and accordingly each of the siamesed ports are communicated through each of inlet pipes 24*a* and 24*b* to the reaction chamber 16 of the exhaust manifold 14. With this arrangement, the surface area of the inner walls of the total exhaust passages 18*a'* and 18*b'* is decreased as compared with that in FIG. 1 to decrease the amount of the heat absorbed therethrough. However, this type of engine has had further problems in which distortion of a portion of the cylinder head 20 adjacent head bolts 26 occurs during normal operation. This distortion results from excessive heating of a portion of the cylinder head 20 which is considerably expanded due to the high temperature exhaust gases. Thus the head bolts 26 which firmly secure that portion of the cylinder head 20 to the cylinder block (not shown) are excessively expanded, especially longitudinally. Additionally, since the head bolts 26 are usually disposed adjacent and between the branched ports 22*a* and 22*b* of the siamesed ports as shown in FIG. 2, the head bolts 26 are longitudinally expanded due to the high temperature exhaust gases passing through the siamesed exhaust ports and therefore leakage of the high pressure combusted gases within the combustion chambers 12*a* and 12*b* tends to occur between the cylinder head and a cylinder head gasket (not shown).

Accordingly, the present invention intends to arrange exhaust ports formed within a cylinder head in such a manner that an integrated exhaust port for two combustion chambers is located as far as possible from head bolts securing the cylinder head to the cylinder block.

Figure 3:
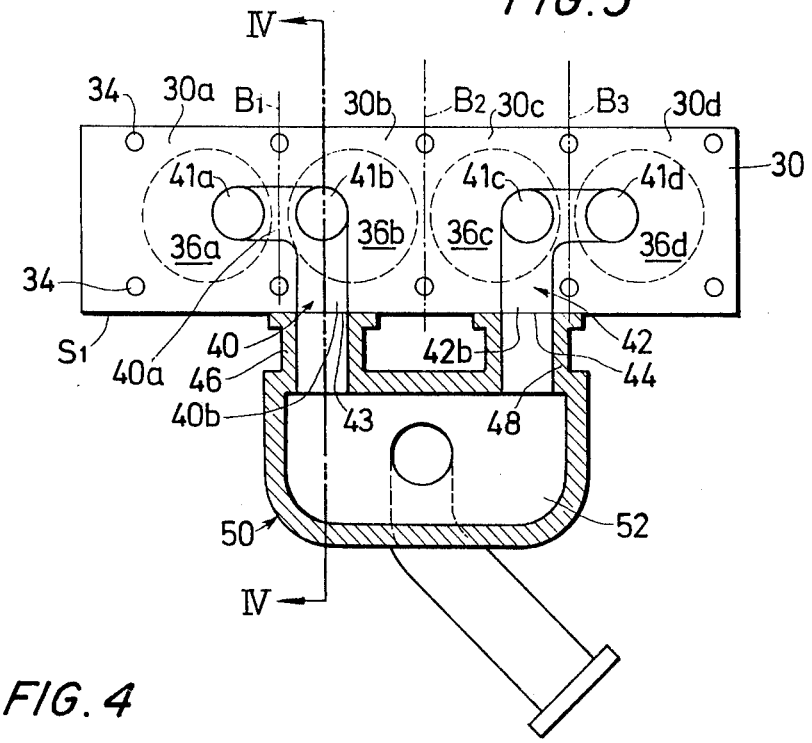
FIG. 3 is a horizontal section view of a first preferred embodiment of an internal combustion engine in accordance with the present invention, equipped with an exhaust manifold having therein a reaction chamber.
Figure 4:
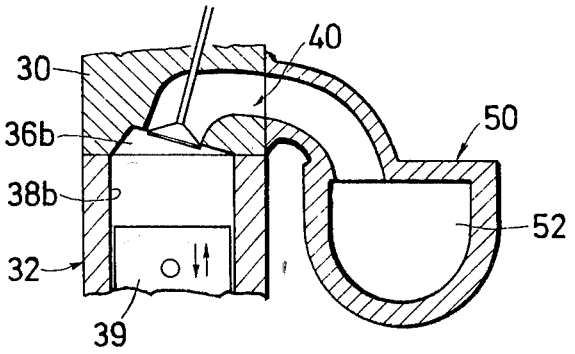
FIG. 4 is a section view taken in the direction of the arrows along the line IV—IV in FIG. 3.

Referring now to FIGS. 3 and 4, there is shown a first preferred embodiment of a multi-cylinder internal combustion engine in accordance with the present invention, in which a cylinder head 30 is secured on the top portion of a cylinder block 32 through a cylinder head gasket (not shown) by head bolts 34. The cylinder head 30 defines at its bottom portion four combustion chambers 36*a* to 36*d* which chambers are respectively agreed with four cylinders 38*a* to 38*d* (of which only one cylinder 38*b* is shown in FIG. 4) formed in the cylinder block 32. Within each of the cylinders 38*a* to 38*d*, a piston 39 is reciprocally disposed as is usual. As shown, first and second exhaust ports 40 and 42 are cast and formed in the cylinder head 30. The first exhaust port 40 for a first group of combustion chambers 36*a* and 36*b* includes a first portion 40*a* and a second portion 40*b*. The first portion 40*a* extends in the longitudinal direction of the cylinder head 30 to be connectable between the two combustion chambers 36*a* and 36*b* through respective exhaust valves 41*a* and 41*b*. The second portion 40*b* connected to the first portion 40*a* extends in the perpendicular direction to the longitudinal axis of the first portion 40*a* and opens at longitudinal one side $S_1$ of cylinder head 30 to form a first opening 43 through which the exhaust gases from the two combustion chambers 36*a* and 36*b* are exhausted. As is apparent from the Figure, the second exhaust port 42 for a second group of combustion chambers 36*c* and 36*d* also includes first and second portions 42*a* and 42*b* configured in a similar manner to the exhaust port 40 and generally symmetrically with respect to the longitudinal center or middle of the cylinder head. The second portion 42*b* has a second opening 44 opened at the side $S_1$ of the cylinder head 30. It will be noted that the first and second openings 43 and 44 of the exhaust ports 40 and 42 are respectively located in portions 30*b* and 30*c* of the cylinder head which are closer to the longitudinal center or middle of the cylinder head 30 than the other portions 30*a* and 30*d* which are located at the ends of same. The four portions 30*a* to 30*d* of the cylinder head are divided by imaginary intermediate vertical planes (shown in broken lines $B_1$ to $B_3$) adjacent the four combustion chambers 36*a* to 36*d*. The head bolts 34 are usually located along these imaginary intermediate lines since the bolts requires relatively large spaces therefor as shown in the figure.

Secured on the side $S_1$ of the cylinder head 30 are two runners 46 and 48 of an exhaust manifold 50 which has a reaction chamber 52 thereinside for treating the exhaust gases introduced from the combustion chambers by further oxidation of unburned constituents contained in the exhaust gases. As seen, the runners 46 and 48 of the manifold are connected through the openings 43 and 44 to the second portions 40*b* and 42*b* of the exhaust ports 40 and 42, respectively. It will be understood that the cylinder head 30 also has therein intake ports though not shown.

With the arrangement mentioned above, the following advantages are obtained: (1) The longitudinal expansion of the head bolts 34 due to the high temperature exhaust gases is prevented and therefore leakage of the high pressure combusted gases from combustion chambers is prevented since the second portions 40*b* and 42*b* and the openings 43 and 44 of the exhaust ports 40 and 42 are located in such a manner that they do not lie on the imaginary vertical planes (shown in the dotted lines) along which the head bolts 34 are usually located. (2) The longitudinal size of the exhaust manifold 50 can be decreased and accordingly the exhaust manifold 50 can be made compact as compared with the prior art shown in FIGS. 1 and 2, since the openings 43 and 44, formed on the side $S_1$ of the cylinder head, of the exhaust ports 40 and 42 are both considerably close to the longitudinal center of the cylinder head 30 resulting the close arrangement of the runners 46 and 48 of the exhaust manifold 50.

Figure 5:
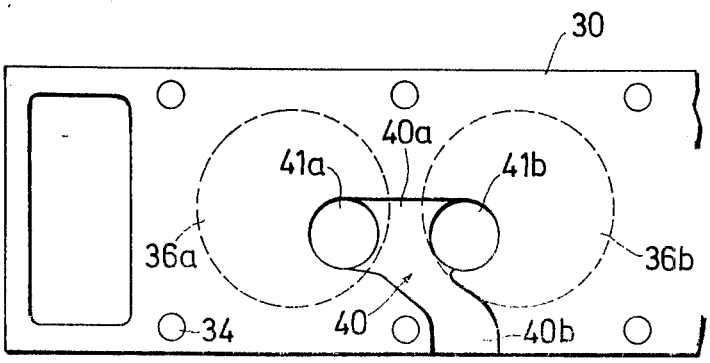
FIGS. 5 to 7 are respectively horizontal section views of the second, third and fourth preferred embodiments of internal combustion engines in accordance with the present invention.

FIG. 5 illustrates a second preferred embodiment of the engine according to the present invention which is similar to the embodiment shown in FIGS. 3 and 4 except that the second portion 40*b* of the exhaust port 40 is connected to the generally longitudinally central portion of the first portion 40*a* of the exhaust port 40. With this construction of the exhaust port 40, the undesirable different effective or substantial length between the exhaust ports of the two combustion chambers 36*a* and 36*b* is removed. Additionally, the exhaust gases passed through the exhaust valve system of one of the two combustion chambers 36*a* and 36*b* are prevented from contacting with the exhaust valve system of the other combustion chamber, and accordingly the exhaust valve systems are prevented from contamination and thermal damage thereof.

While some of the hereinafter discussed embodiments will show only one exhaust port, it is to be understood that the other exhaust port is also configurated similarly to the shown exhaust port.

Figure 6:
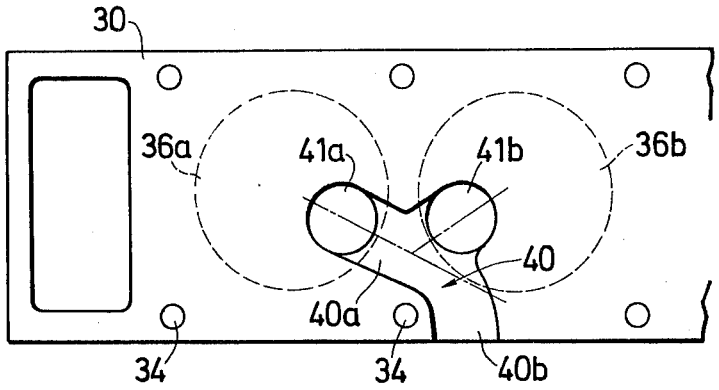

FIG. 6 illustrates a third preferred embodiment of the engine according to the present invention which is similar to the embodiment of FIG. 5 with the exception that the first portion 40*a* of the exhaust port 40 is arranged in such a manner that the longitudinal axis of the part of the first portion 40*a* connected to the one combustion chamber 36*a* angularly intersect the longitudinal axis of the part of the first portion 40*a* connected to the another combustion chamber 36*b*. As shown, the second portion 40*b* of the exhaust port 40 is connected to the first portion 40*a* of the same.

Figure 7:
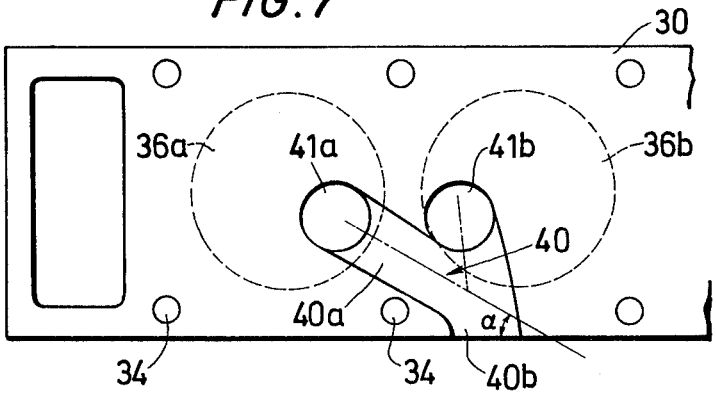

FIG. 7 illustrates a forth preferred embodiment of the engine according to the present invention which is similar to the embodiment of FIG. 6 except that the point of intersection of the longitudinal axes of the parts of the first portions 40*a* connecting the combustion chambers 36*a* and 36*b*, lies at a portion of the exhaust port 40 at which the first and second portions 40*a* and 40*b* connects. It is preferable that the longitudinal axis of the part of the first portion 40*a* connecting the combustion chamber 36*a* constitutes an angle $\alpha$ ranging from 30° to 90° with respect to the longitudinal side surface $S_1$ as seen in the figure. With this configuration, undesirable mutual interference between the exhaust gases from the two combustion chambers 36*a* and 36*b* is decreased and therefore the smooth flow of the exhaust gases in the exhaust port 40 is achieved since the parts of the first portion 40*a* respectively connected to the two combustion chambers are relatively lengthy.

Figure 8:
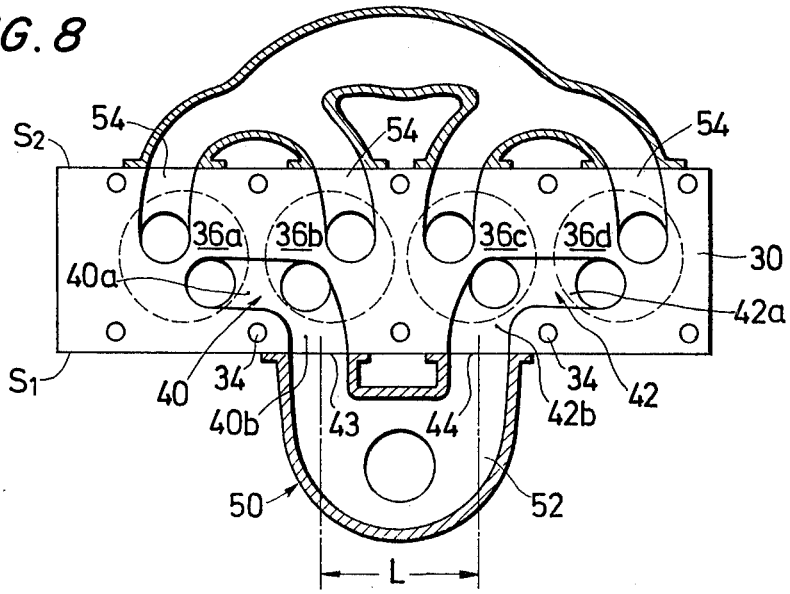
FIG. 8 is a horizontal section view of a fifth preferred embodiment of an internal combustion engine in accordance with the present invention.

FIG. 8 illustrates a fifth preferred embodiment of the engine according to the present invention in which the exhaust ports configuration in accordance with the present invention is applied to a cross-flow induction-exhaust type cylinder head 30 which is equipped with intake ports 54 on one longitudinal side $S_2$ thereof and the exhaust ports 40 and 42 on the longitudinal opposite side $S_1$ thereof. With this configuration, the distance L between the second portions 40*a* and 40*b* of the exhaust ports 40 and 42 can be shortened and accordingly the exhaust manifold 50 having the reaction chamber 52 can be made more compact, for example generally into a hemispherical shape or the like as seen in the figure.

Figure 9:
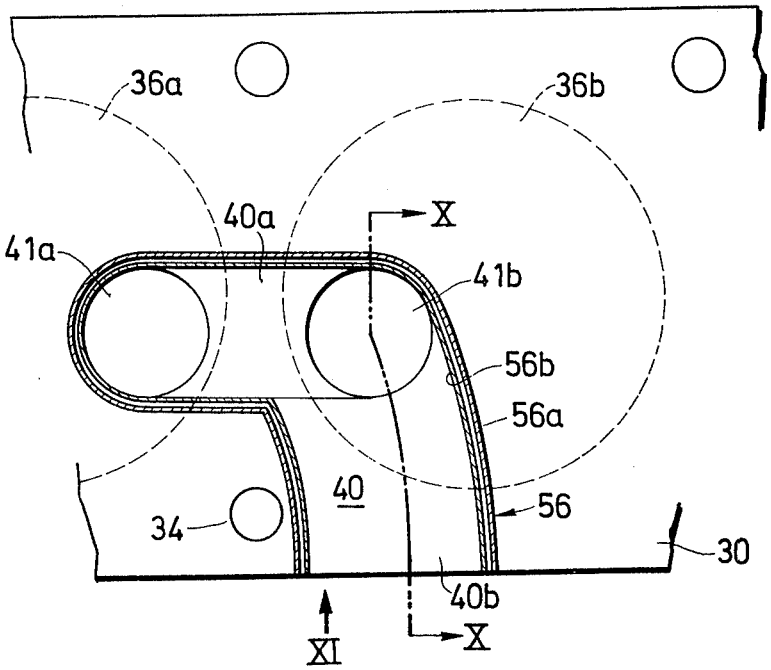
FIG. 9 is a horizontal section view of a sixth preferred embodiment of an internal combustion engine according to the present invention.
Figure 10:
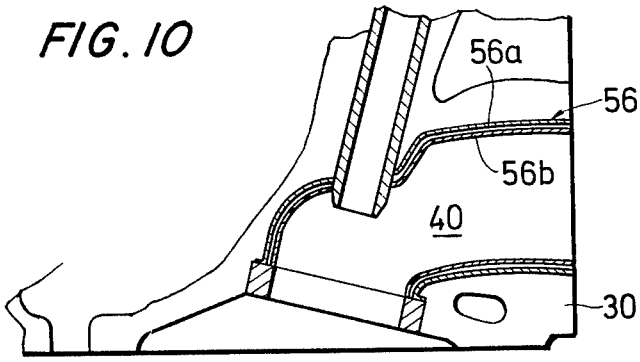
FIG. 10 is a section view taken in the direction of the arrows along the line X—X in FIG. 9.
Figure 11:
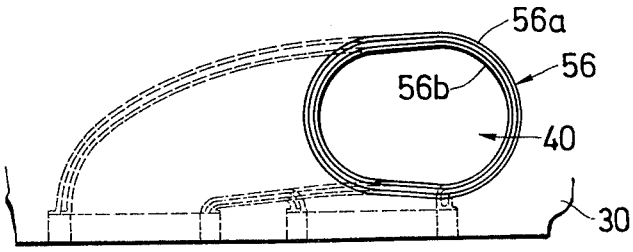
FIG. 11 is an elevational view as viewed in the direction of the arrow XI in FIG. 9.

FIGS. 9, 10 and 11 illustrate a sixth preferred embodiment of the engine according to the present invention which is similar to the embodiment of FIG. 3 except for a double port liner 56 supplied on the inner surface of the exhaust port 40. The double port liner 56 includes outer liner 56*a* and an inner liner 56*b* disposed adjacent to the inner surface of the outer liner 56*a*. With the double port liner of this type, good insulation of the cylinder head is achieved and therefore lowering of the exhaust gas temperature is effectively prevented. The double port liner 56 is formed on the inner surface of the exhaust port by setting the liner during the casting process of the cylinder head 30. In the case in which the double port liner 56 is supplied on a part of the inner surface of the exhaust port, a desired size of the liners 56 is inserted and secured to the part of the exhaust port.

Figure 12:
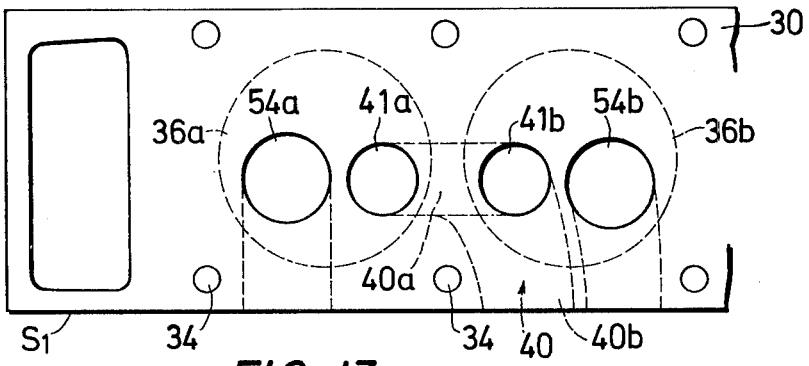
FIG. 12 is a horizontal section view of a seventh preferred embodiment of an internal combustion engine according to the present invention.
Figure 13:
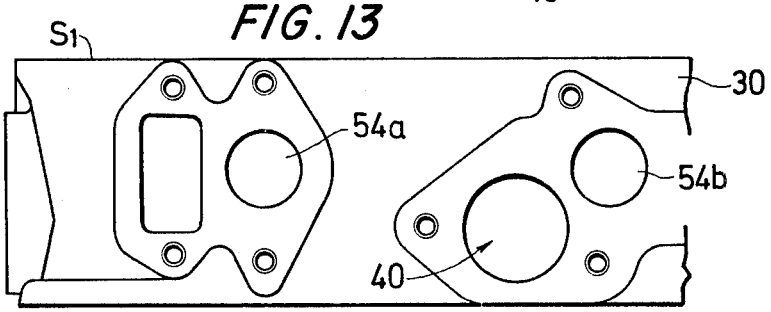
FIG. 13 is an elevational view showing a longitudinal side of the cylinder head of the engine of FIG. 12.

FIGS. 12 and 13 illustrate a seventh embodiment of the engine according to the present invention which is similar to the embodiments discussed above with the exception that the first and second portions 40*a* and 40*b* of the exhaust port 40 have circular cross-sections, in which the cross-sectional area of the second portion 40*b* is designed to be in the range of from one to two times as large as that of the first portion 40*a* in order to decrease the total surface area of the exhaust port 40. In this instance, the intake ports 54*a* and 54*b* for the combustion chambers 36*a* and 36*b* open on the same longitudinal side $S_1$ of the cylinder head 30.

Figure 14:
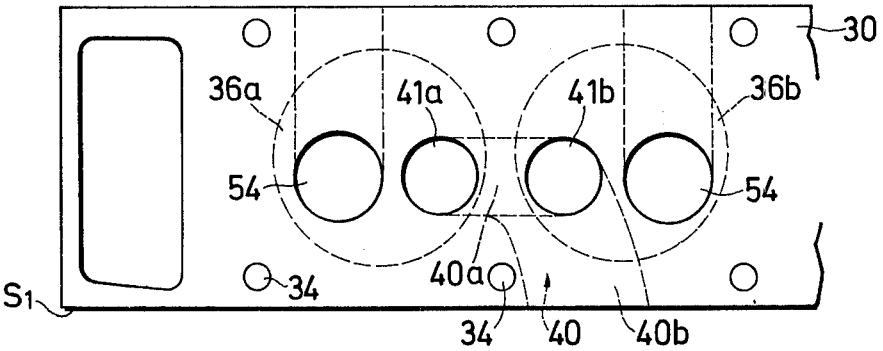
FIG. 14 is a horizontal section view of an eighth preferred embodiment of an internal combustion engine according to the present invention.
Figure 15:
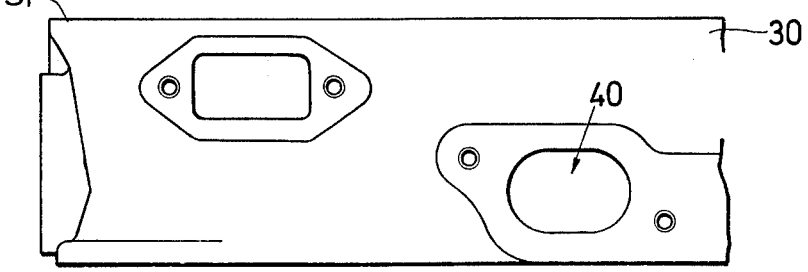
FIG. 15 is an elevational view showing longitudinal side of the cylinder head of the engine of FIG. 14.

FIGS. 14 and 15 illustrate an eighth embodiment of the engine according to the present invention which is similar to the embodiment of FIGS. 12 and 13 except for the shape of the exhaust port 40. The exhaust port 40 has an oval cross-section and accordingly functions like the embodiment of FIGS. 12 and 13. As seen, the cylinder head 30 of this instance is configurated in the cross-flow induction-exhaust type.

Figure 16:
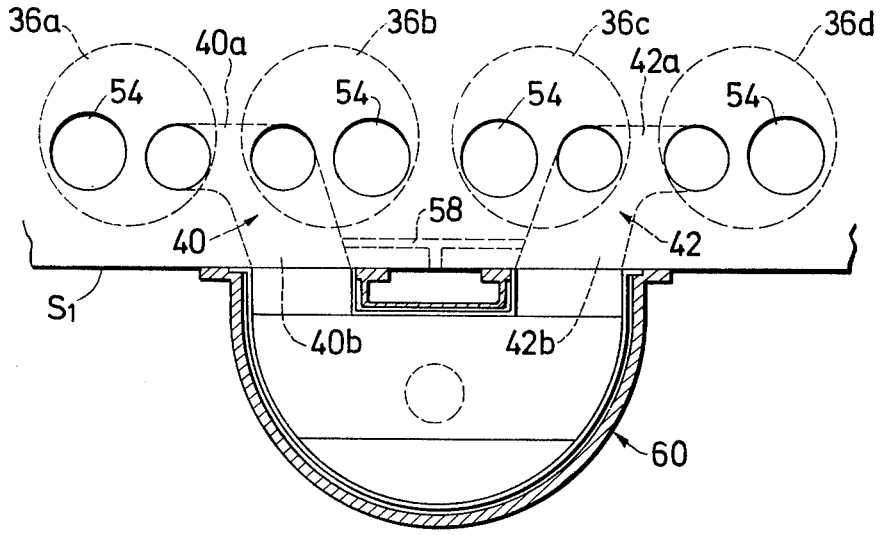
FIG. 16 is a horizontal section view of a ninth preferred embodiment of an internal combustion engine according to the present invention.
Figure 17:
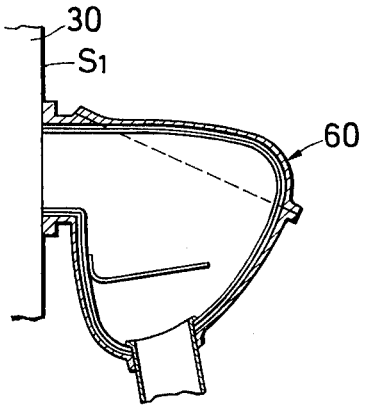
FIG. 17 is a cross-sectional view of the afterburner in FIG. 16.

FIGS. 16 and 17 illustrate a ninth embodiment of the engine according to the present invention which is similar to the embodiment discussed above. This engine is equipped with a secondary air supply passage 58 which is formed in the cylinder head 30 and is connected to the second portions 40*b* and 42*b* of the exhaust ports 40 and 42. With this construction, secondary air from an air source (not shown) is fed through the passage 58 and the second portions 40*b* and 42*b* of the exhaust ports into a thermal reactor 60 which is secured to the longitudinal side $S_1$ of the cylinder head 30 and accordingly the exhaust gases from the combustion chambers 36*a* to 36*d* are effectively reacted in the thermal reactor 60 in order to eliminate the unburned constituents in the exhaust gases.

Figure 18:
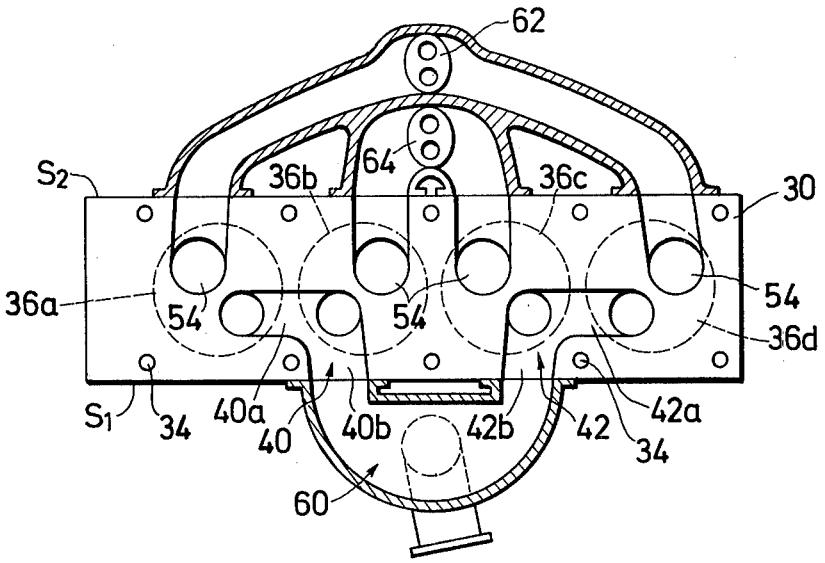
FIG. 18 is a horizontal section view of a tenth preferred embodiment of an internal combustion engine according to the present invention.

FIG. 18 illustrates a tenth embodiment of the engine according to the present invention which is similar to the embodiment shown in FIG. 16 with the exception that the engine of this instance is arranged so that the combustion chambers 36*a* and 36*d* thereof are fed with an air-fuel mixture richer than stoichiometric while the combustion chambers 36*b* and 36*c* thereof are fed with an air-fuel mixture leaner than stoichiometric for the purpose of reducing the formation of nitrogen oxides. It will be understood that the two kinds of air-fuel mixtures are prepared respectively by a carburetor 62 which communicates with the combustion chambers 36*a* and 36*c* and another carburetor 64 which communicates with the other combustion chambers 36*b* and 36*c*.

With the engine of this arrangement, exhaust gases, containing unburned constituents of carbon monoxide and hydrocarbons, from the combustion chambers 36*a* and 36*d* are mixed with exhaust gases, containing excessive oxygen, from the combustion chambers 36*b* and 36*c* in the exhaust ports 40 and 42, respectively, in order to effectively promoting oxidation of the unburned constituents in the exhaust gases. Consequently, reduction of nitrogen oxides, hydrocarbons and carbon monoxide in the exhaust gases from the engine is effectively achieved.

Figure 19:
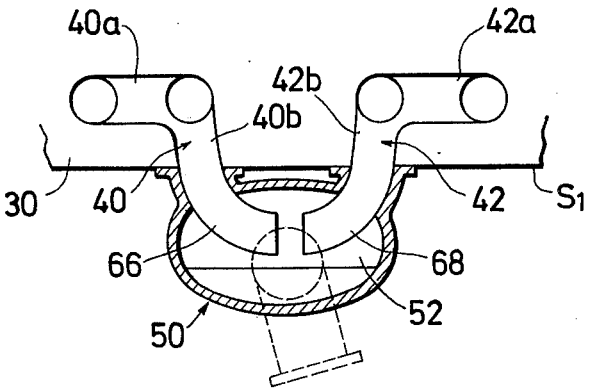
FIG. 19 is a horizontal section view of an eleventh preferred embodiment of an internal combustion engine according to the present invention.
Figure 20:
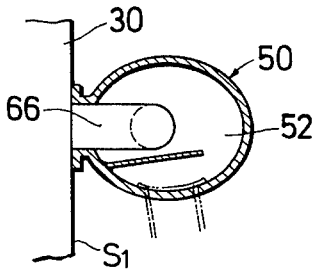
FIG. 20 is a cross-sectional view of the exhaust manifold having the reaction chamber used in FIG. 19.

FIGS. 19 and 20 illustrate an eleventh preferred embodiment of the engine according to the present invention which is similar to the embodiment of FIG. 8 except that the second portions 40*b* and 42*b* of the exhaust ports are extended respectively by using pipes 66 and 68 into the central portion of the reaction chamber 52 of the exhaust manifold 50 in such a manner that the ends of the pipes 66 and 68 are opposed to each other in order to force the exhaust gases from the exhaust ports 40 and 42 together. Accordingly, the reaction of the exhaust gases is effectively accomplished.

Figure 21:
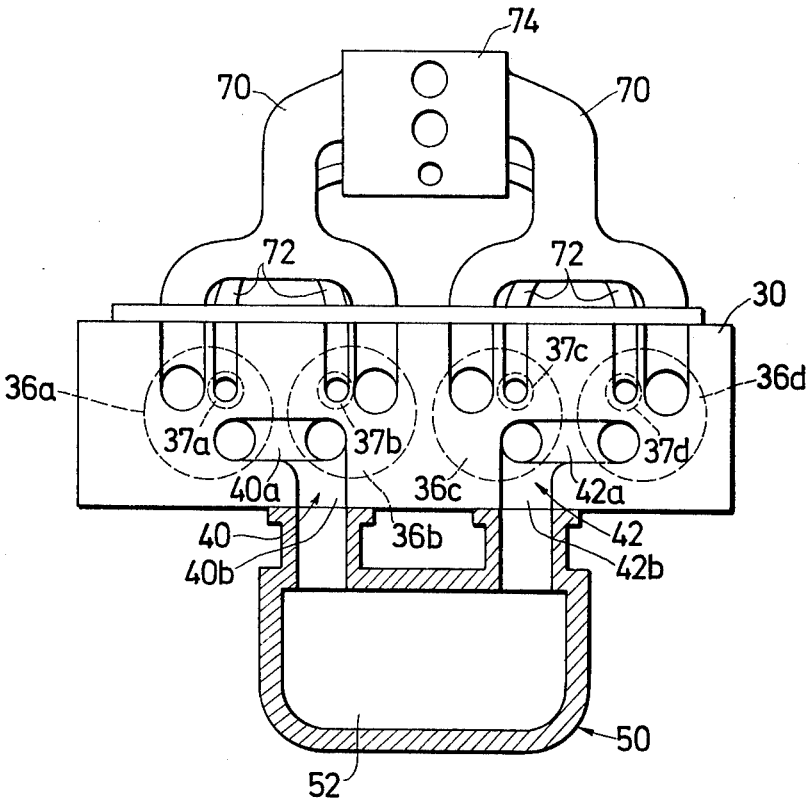
FIG. 21 is a horizontal section view of a twelfth preferred embodiment of an internal combustion engine according to the present invention.

FIG. 21 illustrates a twelfth preferred embodiment of the engine according to the present invention which is similar to the embodiment of FIG. 3. In this embodiment, the exhaust port configuration of the present invention is applied to the engine of the torch ignition type in which the combustion chambers or main combustion chambers 36*a* to 36*d* are respectively communicated, as usual, with auxiliary combustion chambers 37*a* to 37*d*. Each main combustion chamber is arranged to be fed with a relatively lean air-fuel mixture through a main induction system by an air-fuel mixture feed device 74, whereas the each auxiliary combustion chamber is arranged to be fed with a relatively rich air-fuel mixture through an auxiliary induction system 72 by the air-fuel mixture feed device 74. Therefore, it will be understood that clean exhaust gases are emitted from the exhaust system of the engine shown in this figure.

While only engines having four cylinders have been shown and described through the first and twelfth embodiments, it will be understood that the principle of the present invention can be also applied to engines having more than four cylinders.

As is apparent from the foregoing, the engine in accordance with the present invention prevents lowering of the exhaust gas temperature and therefore oxidation of the unburned constituents in the exhaust gases is effectively accomplished in the reactor. In addition, less spark ignition timing retardation is necessary for the engine of the present invention since in the engine of the invention it is not necessary to heat the exhaust gases by retardation of the ignition timing, and consequently engine performance is better compared with the prior art engines which employ the above-mentioned heating technique.

What is claimed is:

1. An internal combustion engine having two cylinders in the cylinder block of the engine, comprising:

a cylinder head secured to the top portion of the cylinder block by head bolts and defining at bottom portion thereof two combustion chambers which are respectively communicated with the two cylinders, said cylinder head having an exhaust port formed therein, said exhaust port including a first portion connectable between said two combustion chambers and a second portion connecting at one end thereof to the first portion and at the other end thereof opening to a longitudinal side of said cylinder head for forming an opening through which the exhaust gases are emitted out of the cylinder head, the opening being located at one of the two portions of the cylinder head which two last mentioned portions are separated by an imaginary intermediate vertical plane, perpendicular with respect to the longitudinal axis of the cylinder head, between the adjacent two combustion chambers.

2. An internal combustion engine as claimed in claim 1, in which said exhaust port has a circular cross-section.

3. An internal combustion engine as claimed in claim 1, in which said exhaust port has a generally oval cross-section.

4. An internal combustion engine as claimed in claim 1, in which the cross-sectional area of the second portion of said exhaust port is in the range of from one to two times as large as that of the first portion of the exhaust port.

5. An internal combustion engine as claimed in claim 1, further comprising a port liner disposed on the inner surface of the exhaust port.

6. An internal combustion engine as claimed in claim 5, in which said port liner including an outer liner and an inner liner disposed ajacent to the inner surface of said outer liner.

7. An internal combustion engine as claimed in claim 1, further comprising a reactor communicated with the second portion of said exhaust port.

8. An internal combustion engine as claimed in claim 7, said reactor is an exhaust manifold having therein a reaction chamber for reburning the unburned constituents contained in the exhaust gases from the combustion chambers.

9. An internal combustion engine as claimed in claim 8, further comprising pipe means connecting to the second portion of the exhaust port and extended into the central portion of the reaction chamber of said exhaust manifold.

10. An internal combustion engine as claimed in claim 7, in which said cylinder head further has secondary air supply passage connecting the second portion of said exhaust port to a secondary air source.

11. An internal combustion engine having four cylinders in the cylinder block of the engine, comprising:

a cylinder head secured on the top portion of the cylinder block and defining at bottom portion thereof a first group of combustion chambers which are respectively communicating with two cylinders of the four cylinders and a second group of combustion chambers which are respectively communicated with the other two cylinders of the four cylinders, said cylinder head having first and second exhaust ports formed therein, said first exhaust port including a first portion connectable between the first group of two combustion chambers and a second portion connecting at one end thereof to the first portion of said first exhaust port and at the other end thereof opening to a longitudinal side of said cylinder head for forming a first opening through which the exhaust gases from the first group of combustion chambers are emitted out of the cylinder head, said second exhaust port including a first portion connectable between the second group of two combustion chambers and a second portion connecting at one end thereof to the first portion of said second exhaust port and at the other end thereof opening to the longitudinal side of said cylinder head for forming a second opening through which the exhaust gases from the second group of combustion chambers are emitted out of said cylinder head, the first and second openings being respectively located at two portions of the cylinder head which is divided into four portions by three imaginary intermediate vertical planes, perpendicular with respect to the longitudinal axis of the cylinder head, respectively disposed intermediately between two adjacent combustion chambers, said two portions of the cylinder head being located closer to the longitudinal middle of the cylinder head than the other portions of the cylinder head;

a plurality of head bolts disposed along portions of the imaginary intermediate vertical planes for securing said cylinder head on the top portion of said cylinder block; and a reactor for reburning exhaust gases from the first and second group of combustion chambers, said reactor having first and second inlet pipes respectively communicated with the second portions of said first and second exhaust ports.

12. An internal combustion engine as claimed in claim 11, in which said reactor is an exhaust manifold having therein a reaction chamber.

13. An internal combustion engine as claimed in claim 13, further comprising means for feeding one of the first group of combustion chambers and one of the second group of combustion chambers with an air-fuel mixture richer than stoichiometric, and means for feeding the other of the first group of combustion chambers and the other of second group of combustion chambers with an air-fuel mixture leaner than stoichiometric.

14. A torch ignition internal combustion engine having four cylinders in the cylinder block of the engine, comprising:

a cylinder head secured on the top portion of the cylinder block by head bolts and defining at bottom portion thereof a first group of main combustion chambers which are respectively communicated with two cylinders of the four cylinders and a second group of combustion chambers which are respectively communicated with the other two cylinders of the four cylinders, said cylinder head having first and second exhaust ports formed therein, said first exhaust port including a first portion connectable between the first group of two main combustion chambers and a second portion connecting at one end thereof to the first portion of said first exhaust port and at the other end thereof opening to a longitudinal side of said cylinder head for forming a first opening through which the exhaust gases from the first group of main combustion chambers are emitted out of the cylinder head, said second exhaust port including a first portion connectable between the second group of two main combustion chambers and a second portion connecting at one end thereof to the first portion of said second exhaust port and at the other end thereof opening to the longitudinal side of said cylinder head for forming a second opening through which the exhaust gases from the second group of combustion chambers are emitted out of said cylinder head, the first and second openings being respectively located at two portions of the cylinder head which is divided into four portions by three imaginary intermediate vertical planes, perpendicular with respect to the longitudinal axis of the cylinder head, respectively disposed intermediately between two adjacent combustion chambers, said two portions of the cylinder head being located closer to the longitudinal middle of the cylinder head than the other portions of the cylinder head;

four auxiliary combustion chambers formed within said cylinder head and respectively communicated with the four main combustion chambers;

means for feeding said four auxiliary combustion chambers with a richer air-fuel mixture than that fed into the four main combustion chambers; and an exhaust manifold having therein a reaction chamber for reburning exhaust gases from the main and auxiliary combustion chambers, said exhaust manifold having two runners which are respectively communicated with the second portions of said first and second exhaust ports.

* * * * *